US006279517B1

(12) United States Patent
Achten

(10) Patent No.: US 6,279,517 B1
(45) Date of Patent: Aug. 28, 2001

(54) FREE PISTON ENGINE PROVIDED WITH A PURGING AIR DOSING SYSTEM

(75) Inventor: Peter Augustinus Johannes Achten, CA Eindhoven (NL)

(73) Assignee: Innas Free Piston B.V., Ae Breda (NL)

( * ) Notice: Subject to any disclaimer, the term of this patent is extended or adjusted under 35 U.S.C. 154(b) by 0 days.

(21) Appl. No.: 09/403,323

(22) PCT Filed: Apr. 17, 1997

(86) PCT No.: PCT/NL97/00201

§ 371 Date: Dec. 7, 1999

§ 102(e) Date: Dec. 7, 1999

(87) PCT Pub. No.: WO98/46870

PCT Pub. Date: Oct. 22, 1998

(51) Int. Cl.[7] ..... F02B 71/00
(52) U.S. Cl. ..... 123/46 R
(58) Field of Search ..... 123/46 R, 46 B, 123/465 C, 46 SC, 463, 62, 66, 67, 68, 69 R, 70 R; 60/495, 496; 417/323, 364

(56) References Cited

U.S. PATENT DOCUMENTS

| | | | | |
|---|---|---|---|---|
| 2,291,594 | * | 7/1942 | Phillips | 123/62 |
| 4,449,488 | * | 5/1984 | Heaton | 123/46 R |
| 4,599,861 | * | 7/1986 | Beaumont | 60/595 |
| 5,287,827 | * | 2/1994 | Almendinger et al. | 123/46 R |
| 5,473,893 | * | 12/1995 | Achten et al. | 60/413 |
| 5,482,445 | * | 1/1996 | Achten et al. | 417/362 |
| 5,775,273 | * | 7/1998 | Beale | 123/46 B |
| 5,893,343 | * | 4/1999 | Rigazzi | 123/46 E |
| 5,934,245 | * | 8/1999 | Miller et al. | 123/296 |
| 6,076,506 | * | 6/2000 | Berlinger et al. | 123/465 C |

* cited by examiner

*Primary Examiner*—Noah P. Kamen
*Assistant Examiner*—Hai Huynh
(74) *Attorney, Agent, or Firm*—Darby & Darby

(57) ABSTRACT

A free piston combustion engine and method by which additional combustion air is supplied by a charge air system. The charge air system includes a piston-cylinder charge air pump in which the piston is movable independently of the movement of the free piston. The charge air pump may be hydraulically driven.

9 Claims, 2 Drawing Sheets

FREE PISTON ENGINE PROVIDED WITH A PURGING AIR DOSING SYSTEM

The invention relates to a free piston engine in accordance with the preamble of claim 1.

Free piston engines of this kind are known from, or instance, WO 96/03575 filed by the applicant.

The disadvantage of the known free piston engines is that after fuel combustion, the combustion gasses do not leave the combustion chamber quickly enough to be replaced by clean oxygen-rich air. As a result the amount of oxygen present in the combustion chamber is limited causing the amount of combustible fuel to be limited and consequently also the energy to be generated by a particular engine.

It is the object of the invention to increase the amount of energy to be supplied by a particular engine and to that end the free piston engine comprises a purging air dosing system provided for supplying additional combustion air, which purging air dosing system comprises means for synchronising the supply of combustion air with the movement of the piston.

This achieves that the moment of supplying additional combustion air can be subject to and adapted to the movement of the piston and the stroke frequency of the engine, so that a limited amount of energy suffices to supply the additional combustion air, and the extra oxygen fed into the combustion chamber is optimally utilized.

In accordance with a first embodiment of the invention the purging air dosing system comprises a second air pump for compressing air, buffer means for storing compressed air and a valve operationable by the synchronising means for dosing compressed air. This is a simple manner to realise separate dosing of additional combustion air.

In accordance with a second embodiment of the invention the purging air dosing system comprises a third air pump having a pump chamber and an air piston movable in the pump chamber, the pump chamber being connected to the first air chamber or the combustion chamber via a nonreturn valve. This avoids the use of a quick-acting valve which is prone to malfunctioning.

In accordance with a further improvement of the invention, the synchronising means comprise sensor means for detecting movement of the piston past an air-dosing position. This further simplifies the control because the purging air dosing depends hereby directly on the position of the piston.

The invention is also embodied in a method of purging combustion gasses from the combustion chamber of the free piston engine in accordance with the invention, which is characterized in that supplying the additional combustion air is started at an adjustable time after starting the movement of the piston. This simple method achieves that after each stroke the engine is ready for the next stroke, irrespective of the stroke frequency.

Figure 1:
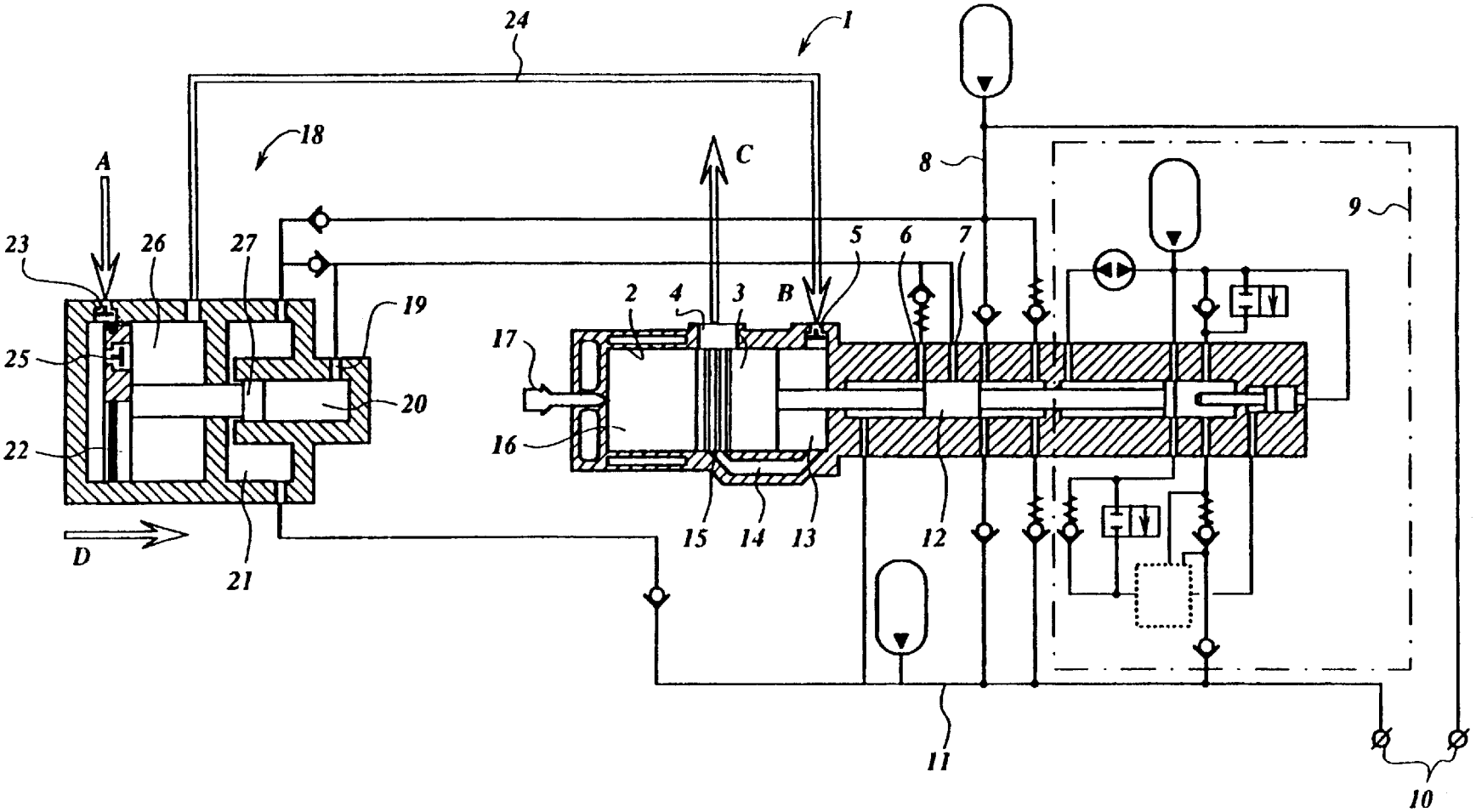
Figure 2:
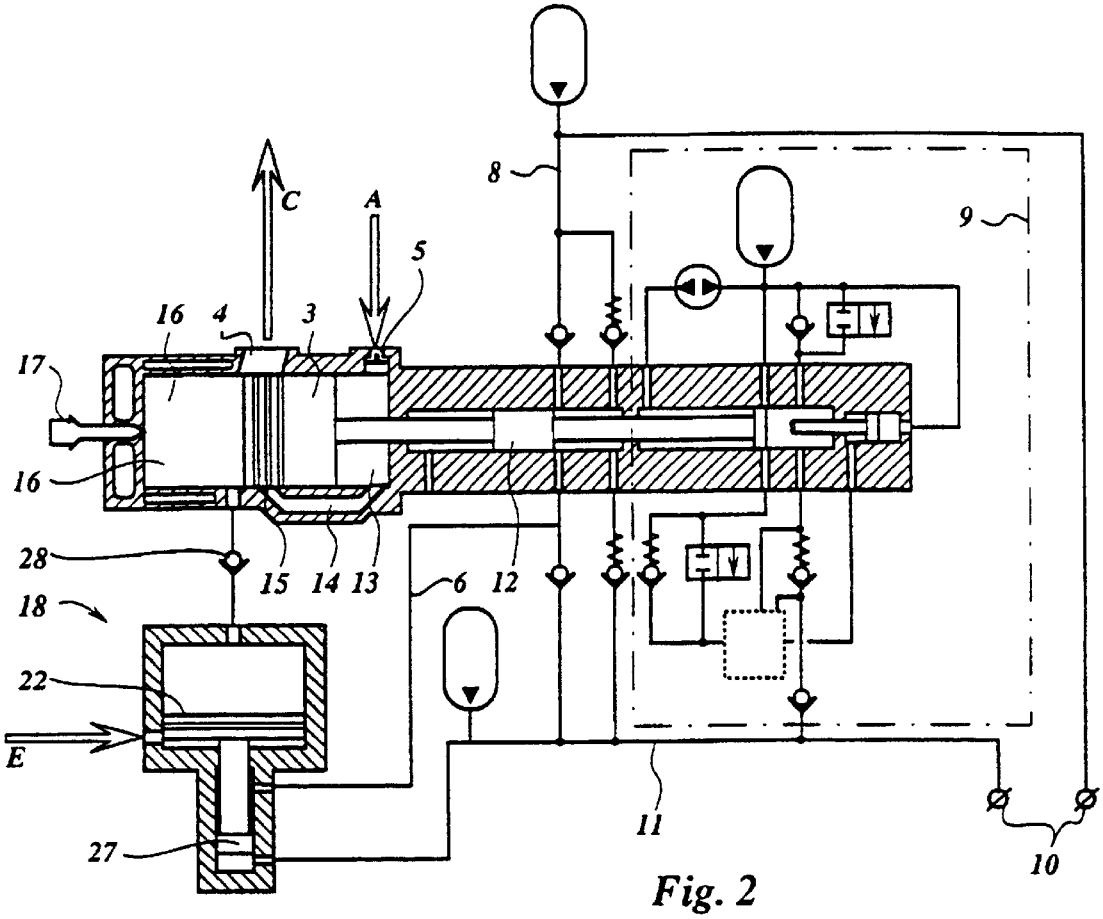
Figure 3:
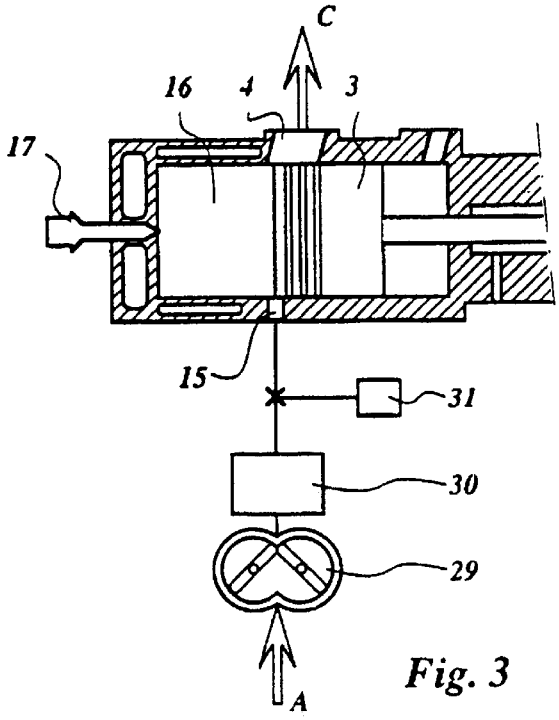

The invention will now be elucidated by means of some examples of embodiments referring to a Figure, in which FIG. 1 shows a schematic representation of a first embodiment of a free piston engine provided with a purging air dosing system;

FIG. 2 shows a schematic representation of a second embodiment of a free piston engine provided with a purging air dosing system; and FIG. 3 shows a schematic representation of a third embodiment of a free piston engine provided with a purging air dosing system.

Identical parts in the different Figures are provided with identical reference numbers.

A free piston engine 1 comprises a cylinder 2 in which a piston 3 can move from a lower dead centre, shown in FIG. 1 when the piston 3 is to the right, to the upper dead centre, shown in FIG. 1 when the piston 3 is to the left. The movement of the piston 3 is effectuated in the known manner by means of a piston drive 9. To the piston 3 an oil piston 12 is connected by means of which oil is pumped from a low-pressure pipe 11 to a high-pressure pipe 8. At 10, a hydraulic system of a user is coupled with the high-pressure pipe 8 and the low-pressure pipe 11.

The piston 3 and the cylinder 2 form a combustion chamber 16 and a purging air chamber 13. The purging air chamber is provided with a purging air supply B, which supply may take place via a non-return valve 5. When the piston 3 moves from the upper dead centre to the lower dead centre and the piston 3 unblocks an inlet opening 15, this purging air flows from the purging air chamber 13 via a purging air channel 14 into the combustion chamber 16. When the piston 3 moves from the upper dead centre to the lower dead centre, it also unblocks an exhaust port 4, from which the exhaust gasses can escape in the direction C. The next operating stroke again compresses the purging air in the combustion chamber 16 and, in the known manner, by means of a fuel injection system 17, fuel is injected into the compressed air, which then ignites in the usual manner.

Purging air supply B takes place through a purging air dosing system 18 which, via a purging air connection 24 and a channel, is connected to or possibly integrated with the purging air chamber 13. The purging air connection 24 is connected to a pump chamber 26 in which a movable air piston 22 is provided. When the air piston 22 is moved in a direction D, it pumps air from an air supply A via a non-return valve 23 and a non-return valve 25 provided in the piston.

The purging air dosing system 18 works as follows: the movement in the direction D occurs owing to the fact that during the movement of the piston's 3 lower dead centre to the upper dead centre a resetting channel 7 comes under high pressure from the pipe 8 with the result that both a cylinder 20 and a surge chamber 21 are subjected to this pressure. The area differences of the piston 27 which are subjected to pressure will make the air piston 22 move in a direction opposite to direction D until the extreme position is reached. The surge chamber 21 has a volume or is provided with an accumulator (not shown) such that when the compressed oil expands, it moves the piston 27 in the direction D. When moving from the upper dead centre to the lower dead centre, the oil piston 12 unblocks a switch channel 6 connecting the cylinder 20 with the low pressure 11, so that the piston 27 can move in the direction D under the influence of the pressure in the surge chamber 21. This drives extra purging air into the purging air chamber 13, the amount and/or the pressure of this purging air, depending among other things on the pressure at 8, and thus depending on the capacity of the engine and the amount of fuel combusted per stroke.

FIG. 2 shows a second embodiment wherein a purging air dosing system 18 is directly connected via a non-return valve 28 with the combustion chamber 16. The air piston 22 will move when during the movement of the piston 3 from the lower dead centre to the upper dead centre, the switch channel 6 is opened. At that moment the pressure at both sides of the piston 27 equalizes and owing to the area difference the air piston 22 will move, causing the air piston 22 to press purging air via a non-return valve 28 into the combustion chamber. Simultaneously new air is drawn in via an opening E.

With the subsequent movement from the upper dead centre to the lower dead centre, the high pressure 8 develops in the switch pipe 6 and the air piston 22 will return to its starting position.

FIG. 3 shows an embodiment wherein the entire air supply A takes place via a pressure booster 29, wherein the purging air is stored in an air buffer means 30 to be dosed via a pop valve 31 into the combustion chamber 16. The pressure booster 29 may be driven in the usual manner such as, for instance, by means of an exhaust-gas turbine coupled to an exhaust port 4. Driving is also possible by means of a hydraulic engine operating on the high pressure 8, so that the power supplied by the pressure booster is proportional to the power supplied by the engine.

The valve 31 is operated through the control of the engine, and the switch time can be varied in order to obtain optimal adaptation to the operational conditions of the engine. The valve is preferably a pop valve as known from, for instance, WO96/03575, by the same applicant.

What is claimed is:

1. A free piston engine for the generation of energy through combustion of fuel mixed with air, comprising a combustion chamber formed at least in part by a first cylinder and a first piston movable in the first cylinder from a lower dead center to an upper dead center, exhaust ports for exhaustion of combustion gases from the combustion chamber, inlet openings for supply of combustion air into the combustion chamber, a purging air pump for placing the combustion air located in a purging air chamber that is connected with the inlet openings under overpressure, a fuel system for supply and mixing of fuel with the combustion air, moving means for accelerating or braking the first piston and for stopping it at the lower dead center, control means by which the duration of the first piston at the low dead center may be adjusted so that stroke frequency can be varied, and a charge air dosing system comprising a charge air pump having a second piston movable in a second cylinder for supplying charge air via a connecting pipe to at least one of the purging air chamber and the combustion chamber, the second piston being movable independently of movement of the first piston.

2. The free piston engine of claim 1 wherein the moving means comprise a hydraulic system, and movement of the second piston is hydraulically driven.

3. The free piston engine of claim 2, wherein the charge air pump includes a surge chamber for containing compressed liquid for driving the second piston.

4. The free piston engine of claim 1 wherein at least a portion of the energy is converted into an oil flow whose pressure is load-dependent, and the oil flow is utilized to move the second piston.

5. A method of supplying charge air to the combustion chamber of claim 1, wherein dosing of charge air begins when the first piston has reached a predetermined position during its movement from the lower dead center.

6. A method of supplying charge air to the combustion chamber of claim 1 wherein the dosing of charge air begins when the first piston has reached a predetermined position during its movement towards the lower dead center.

7. A free piston engine for the generation of energy through combustion of fuel mixed with air, comprising a combustion chamber formed at least in part by a first cylinder and a first piston movable in the first cylinder from a lower dead center to an upper dead center, exhaust ports for the exhaust of combustion gases from the combustion chamber, inlet openings for supply of combustion air into the combustion chamber, a purging air pump for bringing the combustion air in a purging air chamber connected with the inlet openings under overpressure, a fuel system for supply and mixing of fuel with the combustion air, moving means for accelerating or braking the first piston and for stopping it at the lower dead center, control means by which the duration of the first piston at the lower dead center may be adjusted so that stroke frequency can be varied, and a charge air dosing system comprising a charge air pump having a second piston independently movable in a second cylinder for supplying charge air via a connecting pipe to at least one of the purging air chamber and the combustion chamber, wherein the moving means comprise a hydraulic system, and the second piston is hydraulically driven.

8. The free piston engine of claim 7, wherein the charge air pump includes a surge chamber for compressed liquid which serves to drive the second piston.

9. A free piston engine for the generation of energy through combustion of fuel mixed with air, comprising a combustion chamber formed at least in part by a first cylinder and a first piston movable in the first cylinder from a lower dead center to an upper dead center, exhaust ports for the exhaust of combustion gases from the combustion chamber, inlet openings for supply of combustion air into the combustion chamber, a purging air pump for bringing the combustion air in a purging air chamber connected with the inlet openings under overpressure, a fuel system for supply and mixing of fuel with the combustion air, moving means for accelerating or braking the first piston and for stopping it at the lower dead center, control means by which the duration of the first piston at the lower dead center may be adjusted so that stroke frequency can be varied, and a charge air dosing system comprising a charge air pump having a second piston independently movable in a second cylinder for supplying charge air via a connecting pipe to at least one of the purging air chamber and the combustion chamber, wherein at least a portion of the energy is converted into an oil flow whose pressure is load-dependent, and the oil flow is utilized to move the second piston.

* * * * *